US007718907B2

(12) United States Patent
Wildman

(10) Patent No.: US 7,718,907 B2
(45) Date of Patent: May 18, 2010

(54) COMBINATION PRESSURE SWITCH

(75) Inventor: Craig Wildman, Charlotte, NC (US)

(73) Assignee: Condor-Werke Gebr. Frede GmbH & Co. KG., Ennigerloh (DE)

( * ) Notice: Subject to any disclaimer, the term of this patent is extended or adjusted under 35 U.S.C. 154(b) by 513 days.

(21) Appl. No.: 11/734,329

(22) Filed: Apr. 12, 2007

(65) Prior Publication Data

US 2008/0251372 A1 Oct. 16, 2008

(51) Int. Cl.
*H01H 35/24* (2006.01)

(52) U.S. Cl. ..... 200/83 Q; 200/83 R

(58) Field of Classification Search ..... 200/83 R, 200/83 WM, 83 A, 83 J, 83 P, 83 W, 83 Q
See application file for complete search history.

(56) References Cited

U.S. PATENT DOCUMENTS 3,898,403 A * 8/1975 Grayson et al. ..... 200/83 Q
4,081,624 A * 3/1978 Kerman et al. ..... 379/159
4,317,971 A * 3/1982 Roth ..... 200/83 J
4,368,366 A * 1/1983 Kitamura et al. ..... 200/83 Q
4,400,601 A * 8/1983 Brucken ..... 200/81.4
4,401,964 A * 8/1983 Payne ..... 337/343
4,414,845 A * 11/1983 Hofmann ..... 73/114.47
4,692,574 A * 9/1987 Berkhof ..... 200/81.5
4,829,616 A * 5/1989 Walker ..... 5/713
5,144,102 A * 9/1992 Buse ..... 200/83 Q
5,153,396 A * 10/1992 Cummings ..... 200/83 Q
5,285,652 A * 2/1994 Day ..... 62/199
5,570,481 A * 11/1996 Mathis et al. ..... 4/541.2

* cited by examiner

*Primary Examiner*—Michael A Freidhofer
(74) *Attorney, Agent, or Firm*—Adams Intellectual Property Law

(57) ABSTRACT

A combination switch includes a pressure switch moveable between open and closed positions in response to a working pressure of a fluid; an unloader valve moveable between open and closed positions; and a mechanical interconnection between the pressure switch and the unloader valve operable to move the unloader valve in unison with movement of the pressure switch.

17 Claims, 6 Drawing Sheets

COMBINATION PRESSURE SWITCH

BACKGROUND OF THE INVENTION

This invention relates generally to air compressors and related fluid handling systems, and more particularly to valves and controls for such systems.

Fluid handling systems such as air compressors typically utilize a mechanically-driven pump, usually of the positive-displacement type. Usually, the pump is connected to a storage tank or manifold. The tank stores a working volume of air, which serves as a buffer so that the pump does not have to operate continuously. Instead, the pump is run only until the tank is charged to a desired pressure, and then shut off until the pressure is depleted below a usable level. The pump cycling is controlled by a pressure-sensitive switch. Such systems usually also include a "unloader" valve which is effective to vent the pressure on the pump head when the pump is not running. This feature greatly reduces the effort required to restart the pump for a subsequent cycle. Prior art systems typically utilize the unloader valve and pressure switch as separate components, which increases complexity and cost.

BRIEF SUMMARY OF THE INVENTION

Accordingly, it is an object of the invention to provide a single device which combines the functions of a pressure switch and an unloader valve.

It is another object of the invention to provide a single device which interconnects a pressure switch and an unloader valve in a simple linear configuration.

These and other objects are met by the present invention, which according to one aspect provides a combination switch, including: (a) a pressure switch moveable between closed and open positions in response to a working pressure of a fluid; (b) an unloader valve moveable between open and closed positions; and (c) a mechanical interconnection between the pressure switch and the unloader valve operable to move the unloader valve in unison with movement of the pressure switch.

According to another aspect of the invention, the pressure switch includes a pair of electrical contacts which contact each other in the closed position and which are separated in the open position.

According to another aspect of the invention, at least one of the contacts is carried by a current carrying member.

According to another aspect of the invention, the unloader valve includes a valve pin which contacts the current carrying member.

According to another aspect of the invention, the unloader valve includes a valve pin which contacts the current carrying member.

According to another aspect of the invention, the current carrying member is a leaf spring.

According to another aspect of the invention, the unloader valve includes a valve pin which contacts the leaf spring.

According to another aspect of the invention, the unloader valve includes a valve pin which contacts at least one of the contacts of the pressure switch.

According to another aspect of the invention, the pressure switch includes a diaphragm operably connected to the contacts by an actuating pin.

According to another aspect of the invention, the unloader valve includes: (a) a piston axially moveable between open and closed positions, and (b) a spring which urges the piston towards the closed position.

According to another aspect of the invention, the unloader valve and the pressure switch are contained within a housing and aligned for rectilinear motion along an axis of the housing.

According to another aspect of the invention, a combination switch, includes: (a) a housing having a longitudinal axis, a first fluid inlet at a first end, and a second fluid inlet at a second end; (b) a pressure switch disposed at the first end of the housing in fluid communication with the first fluid inlet and moveable between closed and open positions in response to a working pressure of a fluid; and (c) an unloader valve disposed at the second end of the housing and moveable between: (i) a closed position in which the second fluid inlet is blocked; and (ii) an open position in which the second fluid inlet is connected to a fluid outlet. The pressure switch and the unloader valve are mechanically interconnected for unison movement along the longitudinal axis.

According to another aspect of the invention, the unloader valve and the pressure switch are contained within a housing and aligned for rectilinear motion along an axis of the housing.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
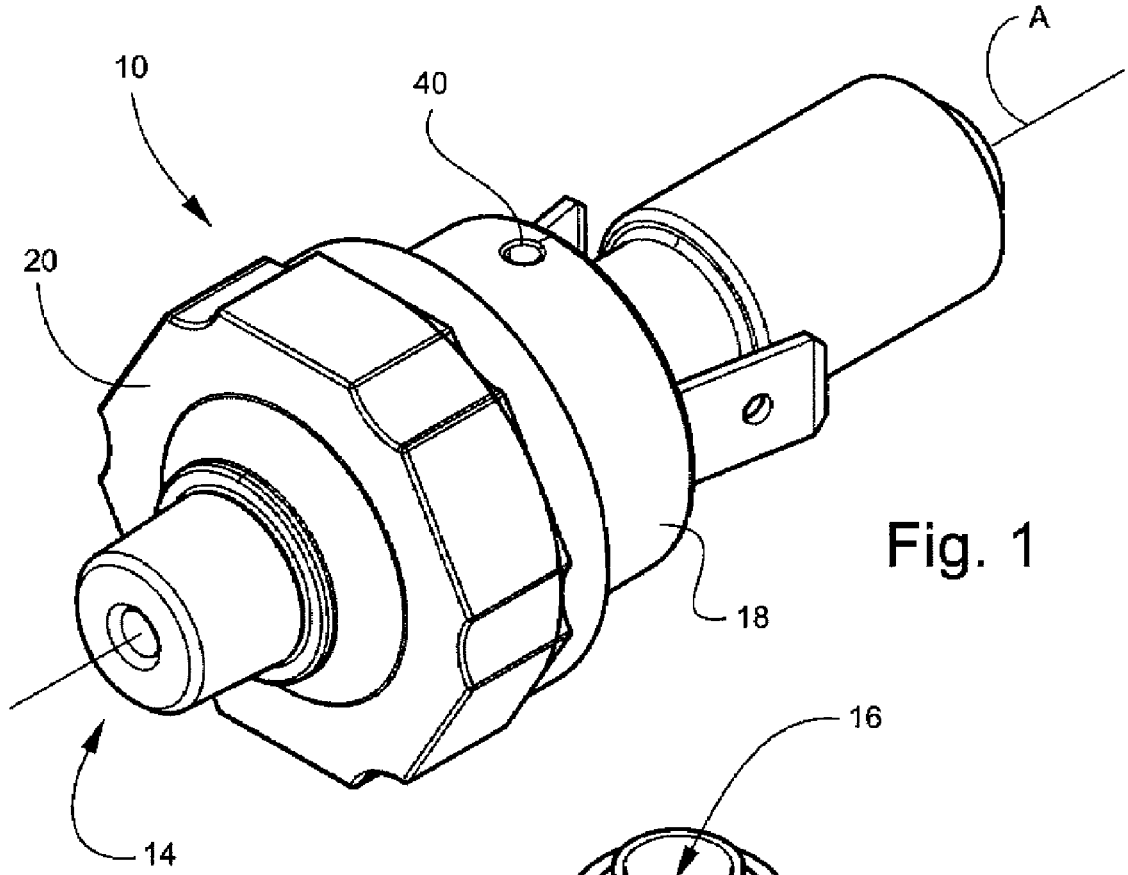
FIG. 1 is a perspective view of a combination switch constructed according to an aspect of the present invention.
Figure 2:
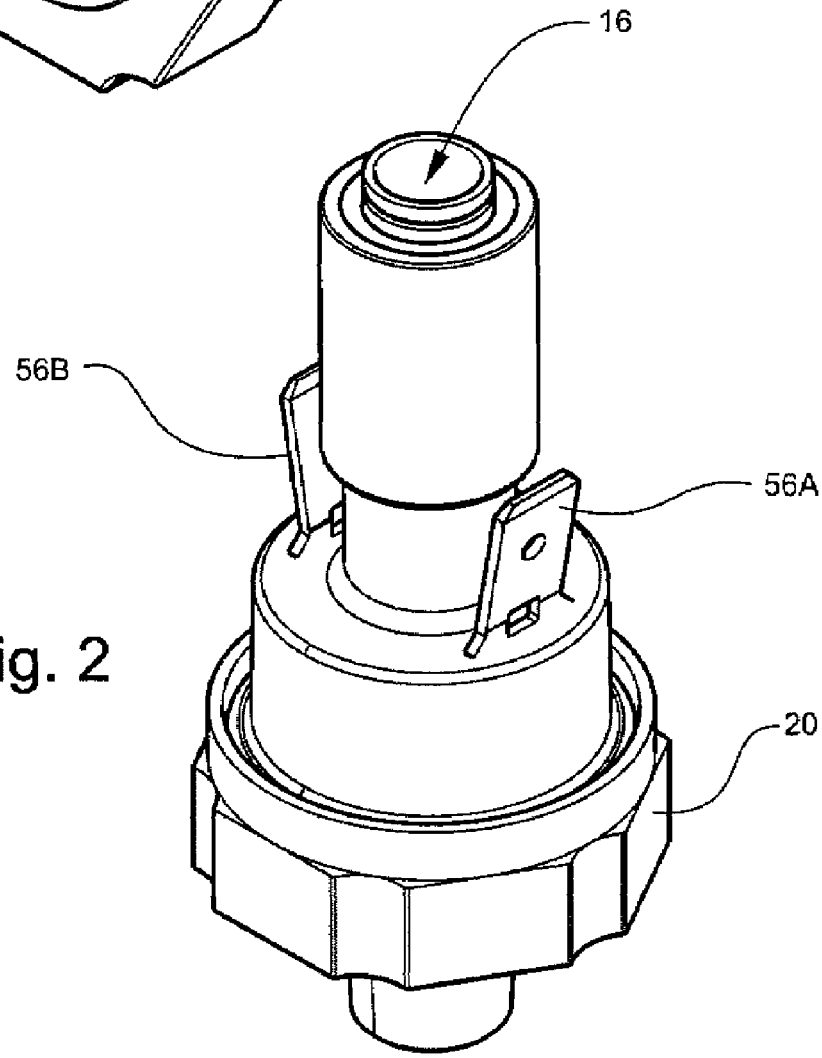
FIG. 2 is a top perspective view of the combination switch of FIG. 1.
Figure 3:
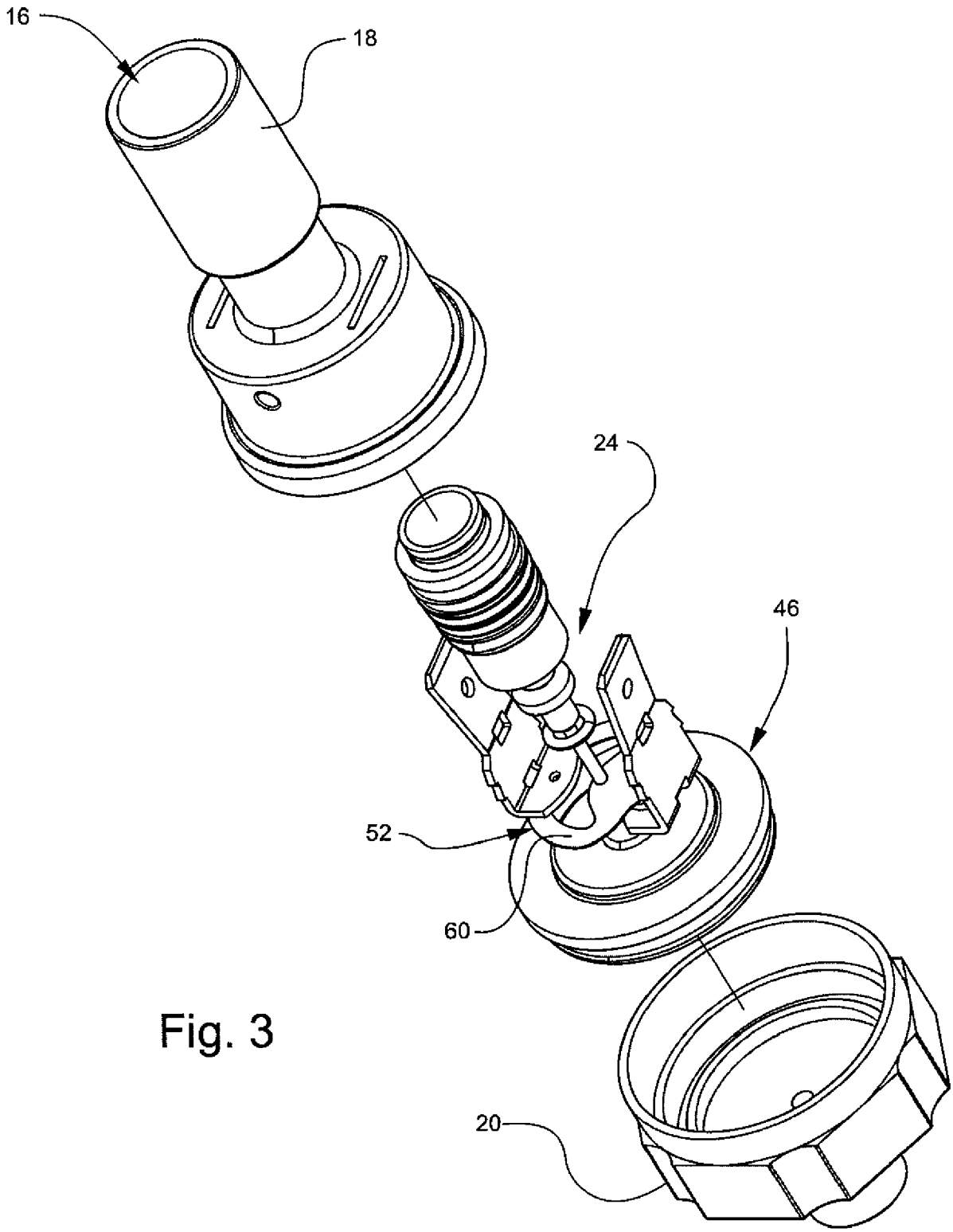
FIG. 3 is an exploded perspective view of the combination switch of FIG. 1.
Figure 4:
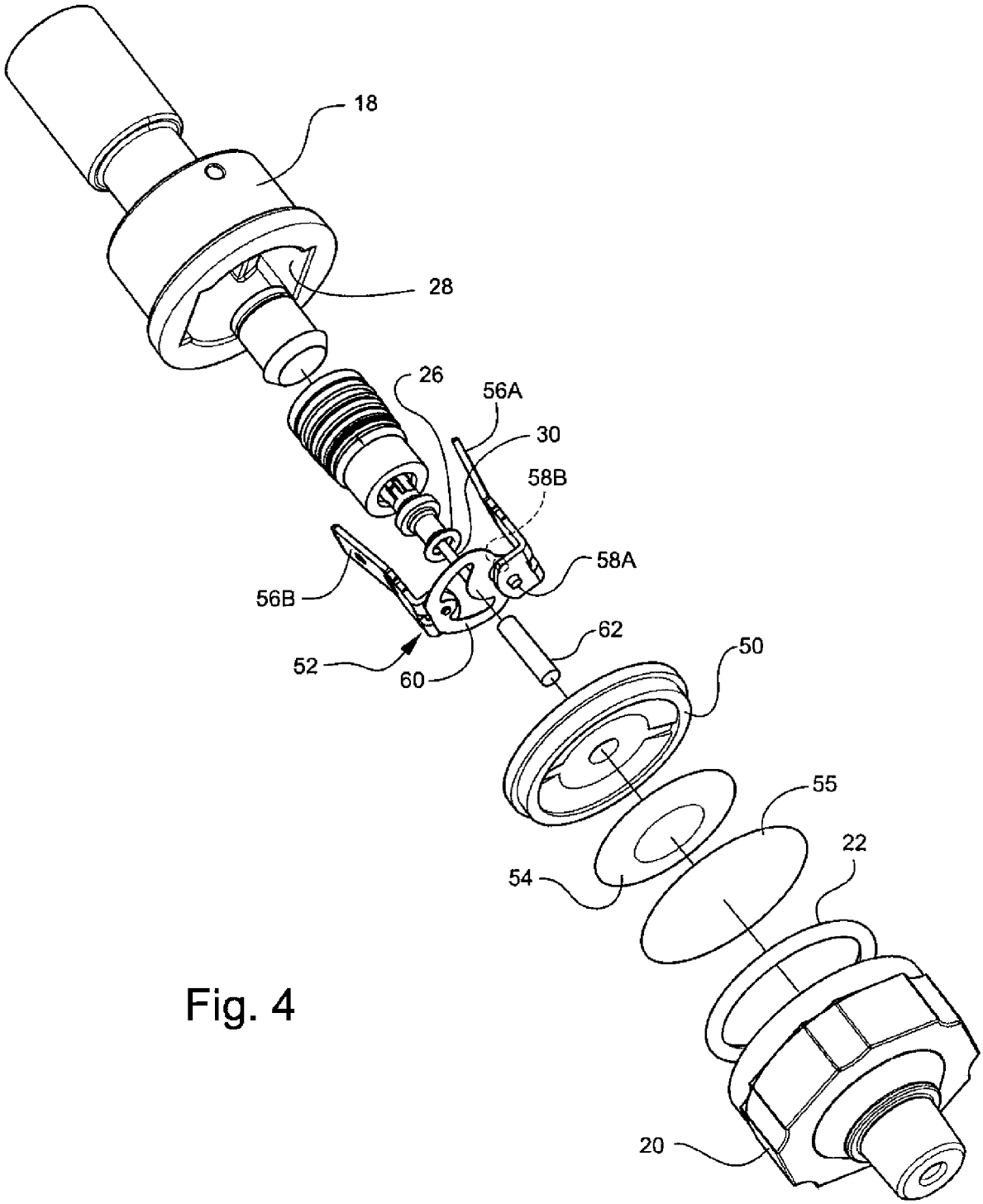
FIG. 4 is another exploded perspective view of the combination switch of FIG. 1.
Figure 5:
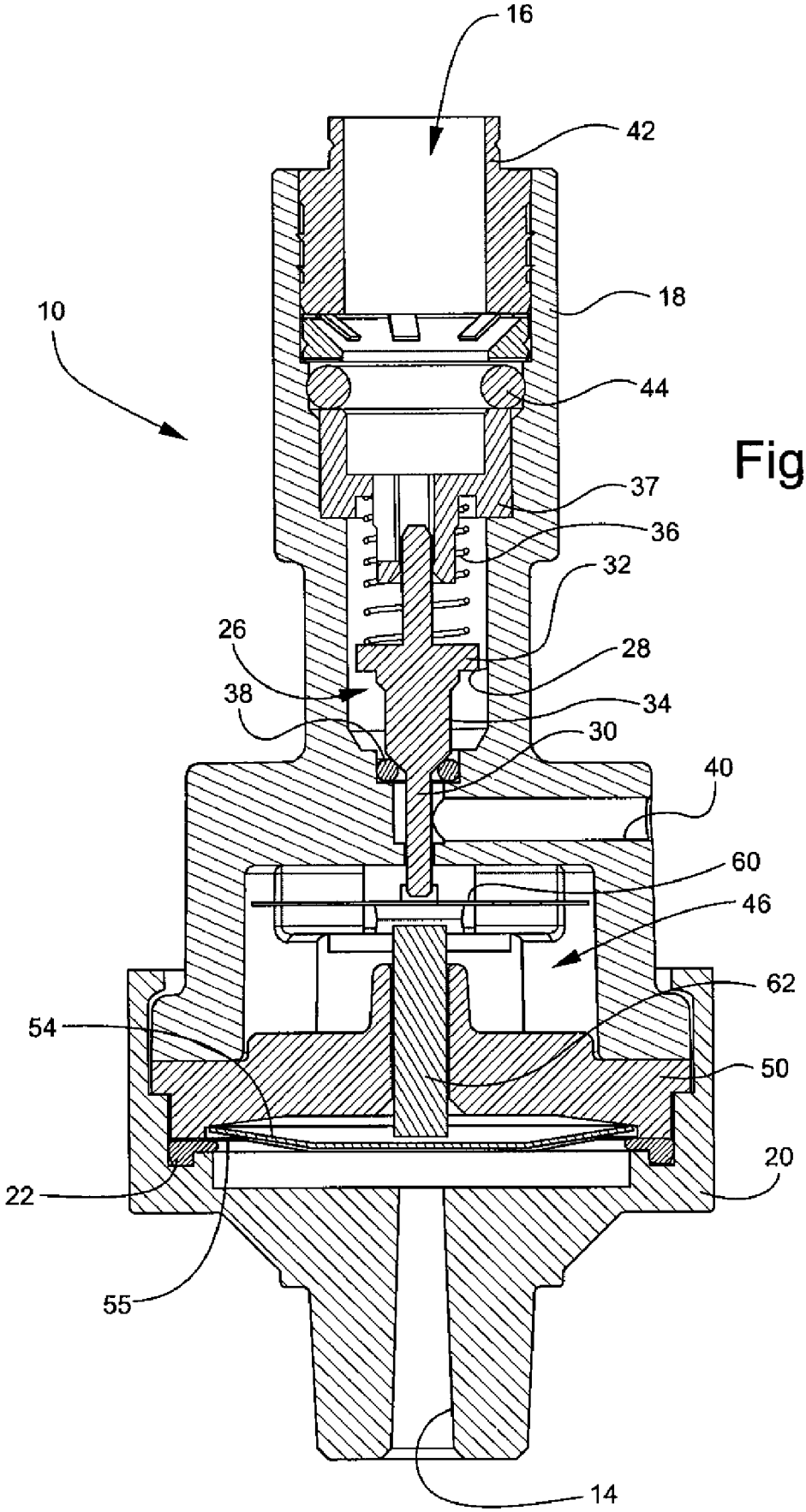
FIG. 5 is a cross-sectional view of the combination switch of FIG. 1.
Figure 6:
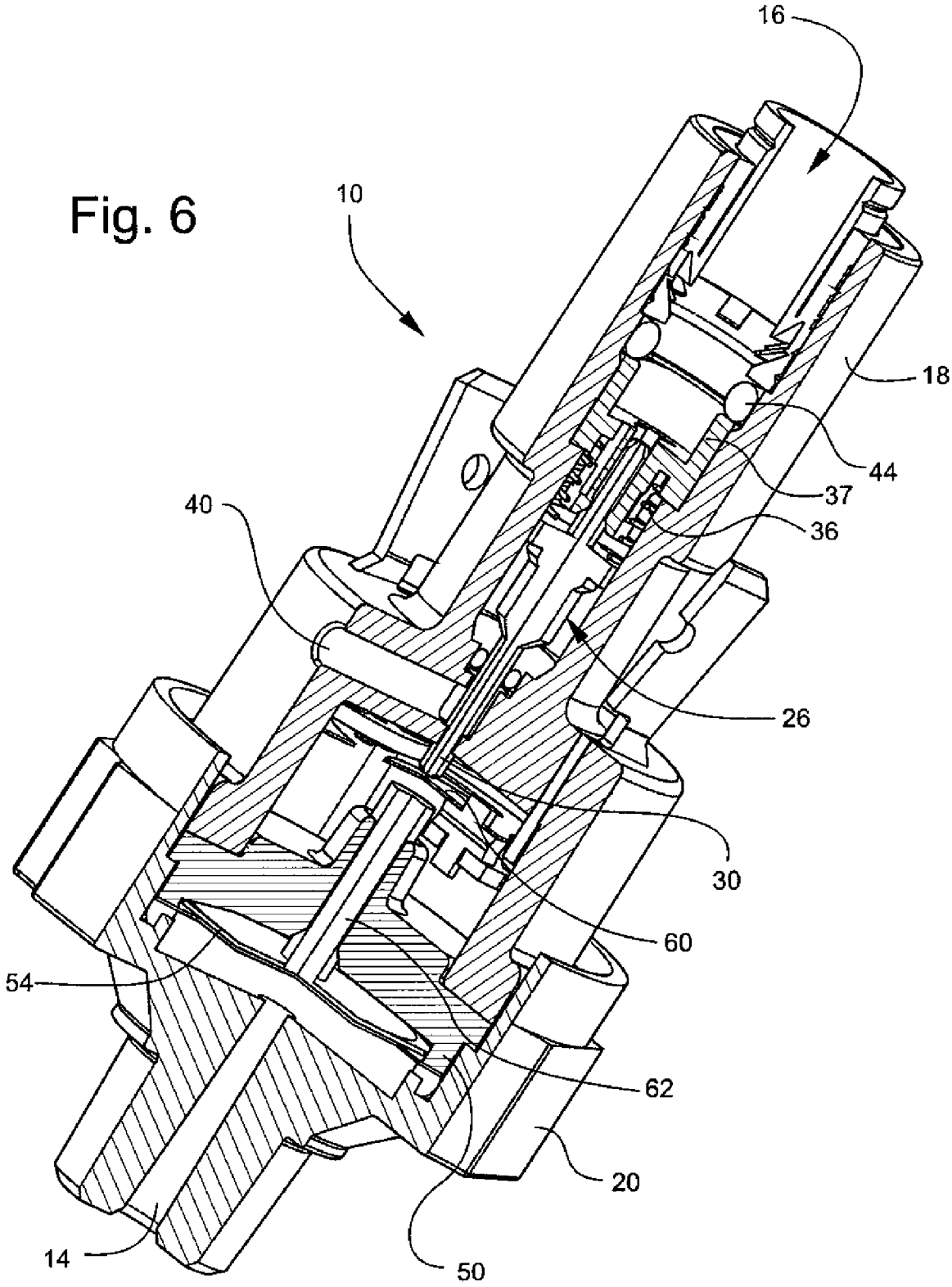
FIG. 6 is a partially sectioned perspective view of the combination switch of FIG. 1.

Referring to the drawings wherein identical reference numerals denote the same elements throughout the various views, FIGS. 1-6 illustrates a combination switch, generally designated at reference number 10. The combination switch 10 has a housing 12 with a longitudinal center line or axis A, a pressure inlet 14, and a vent inlet 16. In this example, the housing 12 comprises a hollow, elongated body 18 which is closed off by a separate end cap 20. Leakage between the body 18 and the end cap 20 is prevented by a lower seal 22, such as the illustrated O-ring (see FIG. 5). The type of housing is not critical, and the internal components of the combination switch 10 could also be housed in a different structure such as a manifold or a combination valve.

The combination switch 10 includes an unloader valve 24 having a piston 26 which moves inside a bore 28 formed in the body 18. The piston 26 has an elongated valve pin 30 with upper and lower ends, and an enlarged-diameter central portion 32 which defines a face 34. A return spring 36 is disposed in the bore 28 above the piston 26 and urges it downward towards a closed position. A spring support 37 serves to locate the upper end of the valve pin 30 and the return spring 36. In the closed position, the face 34 seals against a valve seat 38, which in this example is formed by a resilient O-ring. A vent 40 formed in the body 18 intersects the bore 28 and forms a fluid connection between the vent inlet 16 and the exterior environment when the unloader valve 24 is in a raised, open position. The upper end of the bore 28 is closed off by a hollow plug 42 which also forms the vent inlet 16. Any leakage between the bore 28 and the plug 42 is prevented by an upper seal 44, such as the illustrated O-ring.

A pressure switch 46 is disposed in the body 18 in a chamber 48, beneath the unloader valve 24. A disk-like separator 50 divides the chamber 48 into upper and lower sections. The pressure switch 46 comprises a contact assembly 52 in the upper section and a operating disk 54 in the lower section. The operating disk 54 is of a known type which responds to the differential between atmospheric pressure and the prevailing pressure in the pressure inlet 14. The operating disk 54 has an inherent preload and restoring force that causes it to move to a closed position when pressure is removed. Structurally, the operating disk 54 can be a so-called "snap disk" having a frustoconical shape with a flattened central portion that causes it to "snap" between open and closed positions. This provides some dead band or hysteresis, so as to avoid "hunting" in operation. A flexible, gas-impermeable diaphragm 55 is trapped between the separator 50 and the O-ring 22, and seals off the pressure inlet 14 from the interior of the combination switch 10. The diaphragm 55 has a lower face in fluid communication with the pressure inlet 14, and an upper face in fluid communication with the vent 40.

The contact assembly 52 includes a first terminal 56A and a second terminal 56B which carry first and second contacts 58A and 58B, respectively. The first contact 58A is fixed and the second contact 58B is carried at the end of a moveable, electrically-conductive, current-carrying member. In the illustrated embodiment, the current-carrying member is a leaf spring 60. The leaf spring 60 is biased to keep the contacts 58A and 58B together unless an external force is applied, i.e. the contact assembly 52 is "normally closed" in an electrical sense.

An actuating pin 62 extends through an opening 64 in the separator 50 and is free to move up and down along the axis A. The actuating pin 62 contacts both the operating disk 54 and the leaf spring 60, such that when the operating disk 54 is in a lower position, the contacts 58A and 58B touch each other, and when the operating disk 54 is in an upper position, the contacts 58A and 58B are separated, breaking the electrical flow path between the terminals 56A and 56B.

The lower end of the valve pin 30 of the piston 26 is positioned generally coaxially to the actuating pin 62, and touches the leaf spring 60, essentially forming a continuous linear mechanical path between the operating disk 54 and the piston 26. In this arrangement, when the operating disk 54 is in a lower position, piston 26 is in the closed position, and when the operating disk 54 is in an upper position, the piston 26 is in the open position.

Figure 7:
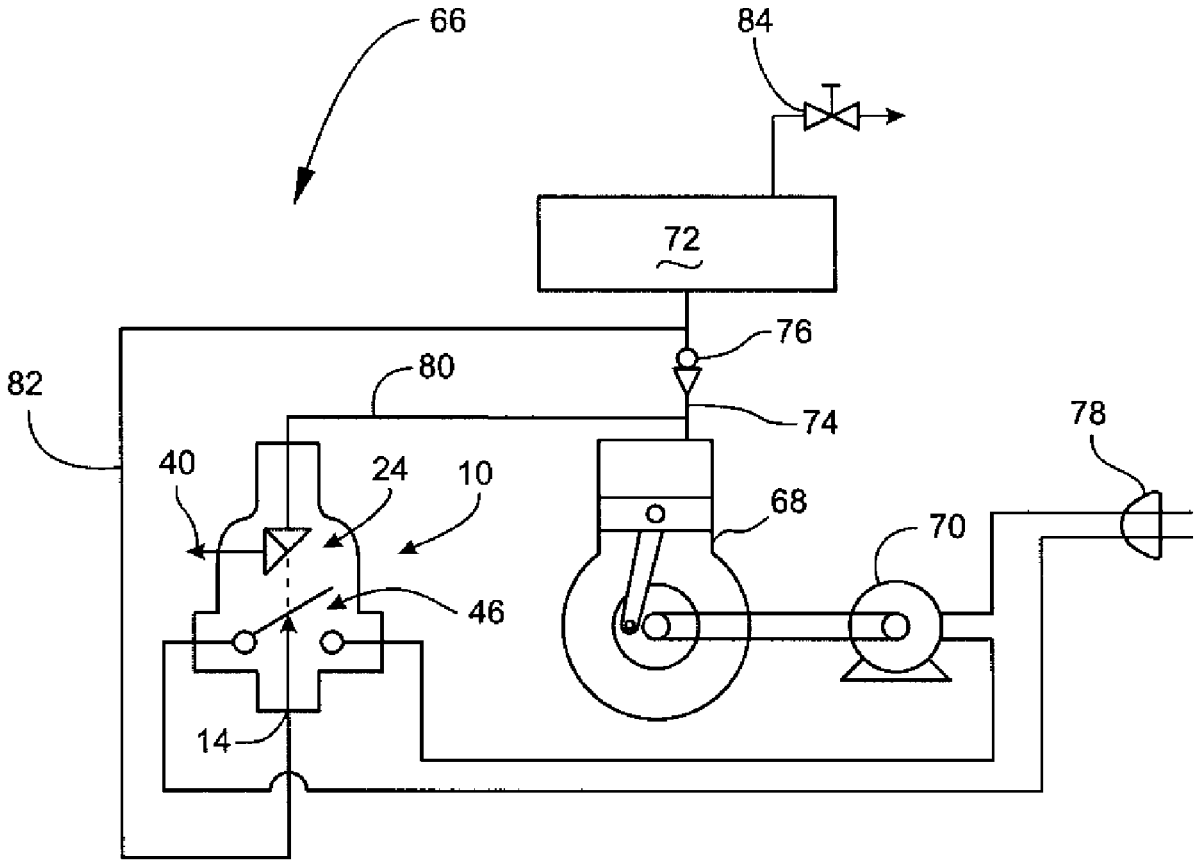
FIG. 7 is a schematic view of a pump system incorporating the combination switch of FIG. 1.

FIG. 7 illustrates schematically a fluid handling system 66 utilizing the combination switch 10 of the present invention. A practical example of such a system would be an air compressor used for powering pneumatic tools and the like. The system has a pump 68 driven by a motor 70, a storage tank 72 connected to the discharge side of the pump 68 through a discharge line 74 which includes a check valve 76, and the combination switch 10 described above. A power source 78 (e.g. mains electrical supply) is connected to the motor 70 through the contacts of the pressure switch 46, and the discharge of the pump 68 is directly connected to the unloader valve 24 through a vent line 80. The storage tank 72 is connected to the pressure inlet 14 via a sensing line 82 connected downstream of the check valve 76. It is noted that FIG. 7 is intended to illustrate only the functional connections between the various components and not necessarily their structure; for example in a practical air compressor the motor 70 is often coupled to the pump 68 with a direct shaft coupling rather than the illustrated belt.

The fluid handling system 66 would typically begin operation with the pressure inside the storage tank, denoted $P_{tank}$, at atmospheric pressure. $P_{tank}$ is communicated to the pressure switch 46 through the sensing line 80. When $P_{tank}$ is less than a set point pressure ($P_{set}$), the pressure switch 46 is closed. This also allows the unloader valve 24 to close against the valve seat 38 under pressure from the return spring 36.

In this condition, the motor 70 will operate the pump 68 to discharge air into the storage tank 72 through the discharge line and check valve 76, and consequently increase the pressure $P_{tank}$. When $P_{tank}$ reaches $P_{set}$, the pressure switch 46 will snap to the open position and stop the motor 70. The actuating pin 62 drives the unloader valve 24 open as described above. Any air pressure within the discharge line 74 upstream of the check valve 76 and the pump 68 is allowed to bleed to atmosphere along a path through the vent line 80, the unloader valve 24, and finally the vent 40. This relieves all pressure on the pump 68. The check valve 76 holds the pressure $P_{tank}$.

The unloader valve 24 and pressure switch 46 stay open as long as $P_{tank}$ is greater than $P_{set}$. Pressure is maintained in the storage tank 72 and may be discharged through an outlet 84 in a known manner, for example to power a pneumatic tool (not shown). When $P_{tank}$ falls below $P_{set}$, the pressure switch 46 closes, starting the pump 68, and it allows the unloader valve 24 to close under pressure from the return spring 36. This allows the pump 68 to charge the storage tank 72. The pressure switch 46 typically operates with some degree of "dead band" or hysteresis in the set point, in a known manner, so as to avoid excessive on-and-off cycling of the motor 70 and pump 68. For example, the Pset needed to cause the motor 70 to cycle "off" may be substantially higher than the Pset needed to cause the motor 70 to cycle "on".

The foregoing has described a combination switch. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A combination switch, comprising:

(a) a housing having a longitudinal axis, a first fluid inlet at a first end, and a second fluid inlet at a second end;

(b) a pressure switch disposed at the first end of the housing in fluid communication with the first fluid inlet and moveable between closed and open positions in response to a working pressure of a fluid;

(c) an unloader valve disposed at the second end of the housing and moveable between an open position in which the second fluid inlet is connected to a fluid outlet, and a closed position in which the second fluid inlet is blocked; and (d) a mechanical interconnection between the pressure switch and the unloader valve operable to move the unloader valve in unison with movement of the pressure switch.

2. The combination switch of claim 1 wherein the pressure switch includes a pair of electrical contacts which contact each other in the closed position and which are separated in the open position.

3. The combination switch of claim 2 in which at least one of the contacts is carried by a current carrying member.

4. The combination switch of claim 3 wherein the unloader valve includes a valve pin which contacts the current carrying member.

5. The combination switch of claim 4 wherein the unloader valve includes a valve pin which contacts the leaf spring.

6. The combination switch of claim 3 in which the current carrying member is a leaf spring.

7. The combination switch of claim 2 wherein the unloader valve includes a valve pin which contacts at least one of the contacts of the pressure switch.

8. The combination switch of claim 1 wherein the pressure switch includes an operating disk operably connected to the contacts by an actuating pin.

9. The combination switch of claim 1 wherein the unloader valve includes:

(a) a piston axially moveable between open and closed positions, and (b) a spring which urges the piston towards the closed position.

10. A combination switch, comprising:

(a) a housing having a longitudinal axis, a first fluid inlet at a first end, and a second fluid inlet at a second end;

(b) a pressure switch disposed at the first end of the housing in fluid communication with the first fluid inlet and moveable between closed and open positions in response to a working pressure of a fluid; and (c) an unloader valve disposed at the second end of the housing and moveable between:

(i) a closed position in which the second fluid inlet is blocked; and (ii) an open position in which the second fluid inlet is connected to a fluid outlet;

wherein the pressure switch and the unloader valve are mechanically interconnected for unison movement along the longitudinal axis.

11. The combination switch of claim 10 in which the pressure switch and the unloader valve are interconnected such that the unloader valve is moved to the open position when the pressure switch is in the open position.

12. The combination switch of claim 11 in which at least one of the contacts is carried by a leaf spring.

13. The combination switch of claim 11 wherein the unloader valve includes a valve pin which contacts at least one of the contacts of the pressure switch.

14. The combination switch of claim 11 wherein the pressure switch includes an operating disk operably connected to the contacts by an actuating pin.

15. The combination switch of claim 11 wherein the unloader valve includes:

(a) a piston axially moveable between open and closed positions, and (b) a spring which urges the piston towards the closed position.

16. The combination switch of claim 11 wherein the unloader valve and the pressure switch are contained within a housing and aligned for rectilinear motion along an axis of the housing.

17. The combination switch of claim 10 wherein the pressure switch includes a pair of electrical contacts which contact each other in the closed position and which are separated in the open position.

* * * * *